US006200149B1

(12) United States Patent
Chi-Chung

(10) Patent No.: US 6,200,149 B1
(45) Date of Patent: Mar. 13, 2001

(54) CARD EDGE CONNECTOR

(75) Inventor: Chen Chi-Chung, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/335,016

(22) Filed: Jun. 17, 1999

(30) Foreign Application Priority Data

Jun. 20, 1998 (TW) ..... 87209889

(51) Int. Cl.[7] ..... H01R 13/62
(52) U.S. Cl. ..... 439/160; 439/157
(58) Field of Search ..... 439/159, 160, 439/157, 637

(56) References Cited

U.S. PATENT DOCUMENTS 5,443,394 8/1995 Billman et al. ..... 439/157
5,620,342 4/1997 Kinross ..... 439/637
5,676,555 10/1997 Yu et al. ..... 439/157
5,749,750 5/1998 Yu et al. ..... 439/637
5,775,925 * 7/1998 Tondreault ..... 439/157

FOREIGN PATENT DOCUMENTS

WO 9708782 3/1997 (WO) .

* cited by examiner

*Primary Examiner*—Brian Sircus
*Assistant Examiner*—Son V. Nguyen

(57) ABSTRACT

Disclosed is an electrical connector for connecting a first circuit board to a second circuit board. The electrical connector for mounting on the second circuit board comprises an insulative housing having a slot for receiving the first circuit board therein. A lever is rotatably mounted in a recess at an end of the housing. The lever rotatably moves in a first plane to affect the position of the first circuit board in the slot. The lever includes a support arm with a vertical surface constantly juxtaposed to a portion of the housing to limit the lever from rotating in a second plane angular to the first plane.

20 Claims, 9 Drawing Sheets

CARD EDGE CONNECTOR

FIELD OF THE INVENTION

The present invention relates to a card edge connector for connecting a daughter circuit board to a mother circuit board. The invention particularly relates to a card edge connector which comprises a lever that can be smoothly rotated inwardly to latch the daughter circuit board in the connector or outwardly to eject the daughter circuit board from the connector.

BACKGROUND OF THE INVENTION

Edge card connectors are used for connecting a circuit board with conductive pads along a lower edge, such as a daughter circuit board or a daughter card, to an underlying circuit board, such as a mother circuit board. Terminals loaded in a housing of the connector along a slot for receiving the daughter circuit board connect the conductive pads on the daughter circuit board to conductors on the mother board. Edge card connectors typically employ a lever disposed at one side of a housing of the connector, which is rotated inwardly to latch the daughter circuit board in a slot in the connector and rotated outwardly to eject the daughter circuit board from the slot in the connector.

The levers for such card edge connectors sometimes undesirably rotate or swivel in a plane which is perpendicular to a plane defined by the intended rotational movement of the lever. The plane of rotational movement is normally parallel to the slot in the connector. The undesirable rotation or swiveling of the lever is aggravated when the lever is subjected to lateral forces which are typical in the manufacturing, assembly and shipping of these connectors. Such lateral forces can cause the lever to excessively rotate or swivel thereby unfortunately causing damage to the lever.

These levers are also prone to vibration. As a result of vibration, the contact impedance between the conductive pads of the daughter circuit board and the terminals in the connector can become unstable.

FIG. 8 shows a conventional edge card connector according to U.S. Pat. No. 5,470,240. The structure of the edge card connector includes an insulative housing 1, a plurality of conductive contacts 3 mounted in the insulative housing 1 for connection to connecting pads of the circuit board (not shown), and two levers 5 pivotally mounted at pivot points 8 on the insulative housing 1 at two opposite ends, respectively. The levers 5 each comprise a wrench arm 7 at the bottom, and a side projection 9 near the top thereof. When the levers 5 are rotated inwardly, the side projections 9 of the levers 5 are engaged into respective side recesses 4 at two opposite side edges of the daughter circuit board 2. To remove the daughter circuit board 2 from the insulative housing 1, one lever 5 is rotated outwardly to disengage the side projection 9 from the corresponding side recess 4, and at the same time the respective wrench arm 7 is rotated upwardly to lift the daughter circuit board 2 from the insulative housing 1. The main drawback of this structure is that the edge card connector has no means to protect the levers against destruction from lateral impact.

FIG. 9 shows another structure of a prior art edge card connector comprising a housing 1' for receiving a daughter circuit board (not shown) to connect contact pads on the circuit board to terminals 3'. A lever 5' has a wrench arm 7' for ejecting the daughter circuit board from the connector 1'. However, this structure is still not satisfactory in function. The expanded opposite end of the insulative housing 1' which is designed to reinforce the structural strength of the insulative housing greatly increases the transverse dimension of the edge card connector. Further, the lever 5' has flanges 9' that are moved by rotation of the levers 5' in and out of the space between respective parallel upright supports 6 of the insulative housing 1' to stabilize movement of the levers 5'. However, when the levers are turned outwardly, the flanges are disengaged from the upright supports, thereby becoming vulnerable to damage from lateral impact.

SUMMARY OF THE INVENTION

It is an object of the present invention to provide an edge card connector that has a lever for holding a daughter circuit board firmly in position against vibration. It is another object of the present invention to provide an edge card connector for receiving a daughter circuit board having a lever that can withstand damage from lateral impact.

To achieve these and other objects of the present invention, there is provided an electrical connector for connecting a first circuit board to a second circuit board. The electrical connector comprises an insulative housing having a first wall and a second wall extending from a first end to a second end and defining a top face. A slot in the top face extends from the first end to the second end between the first and second walls for receiving the first circuit board therein. A recess is also disposed in at least one of the first end and the second end. Terminal cavities are disposed in at least one of the first wall and the second wall adjacent to the slot. A plurality of terminals are mounted in the terminal cavities. Each of the terminals have a contact portion extending into the slot for contacting conductive pads on the first circuit board when received in the slot and a tail portion extending out of the insulative housing to contact conductors on the second circuit board. A lever is rotatably mounted in the recess at one of the first end and the second end of the insulative housing. The lever rotatably moves in a first plane to affect the position of the first circuit board in the slot. The lever includes a support arm with a vertical surface constantly engaged with a portion of the housing to limit the lever from rotating in a second plane angular to the first plane.

As also disclosed herein, the lever has two sides and the arm extends from each side. The recess in the insulative housing may also include a first wall and a second wall. The first wall and the second wall of the recess preferably extend upwardly from the top face of the housing and the support arm is adjacent to the first wall. The vertical surface of the support arm may be adjacent to the first upstanding wall. The housing may further include a first aperture in a first wall of the recess in registry with a second aperture in the second wall of the recess, and the lever includes a first shaft and a second shaft for reception in respective ones of the first aperture and the second aperture to rotatably mount the lever in the recess. A lower end of the support ann is preferably chamfered. The lever also may have an ejecting surface for engaging a portion of the first circuit board and lifting the first circuit board up in the slot upon rotation of the lever. The lever may also have latching surface for engaging a portion of the first circuit board and holding the first circuit board down in the slot. The lever may further have an extended gripping section for manually rotating the lever.

As further disclosed herein, the support arm preferably comprises a horizontal segment extending outwardly from the first side or the second side of the lever and a vertical segment extending downwardly from the horizontal segment.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
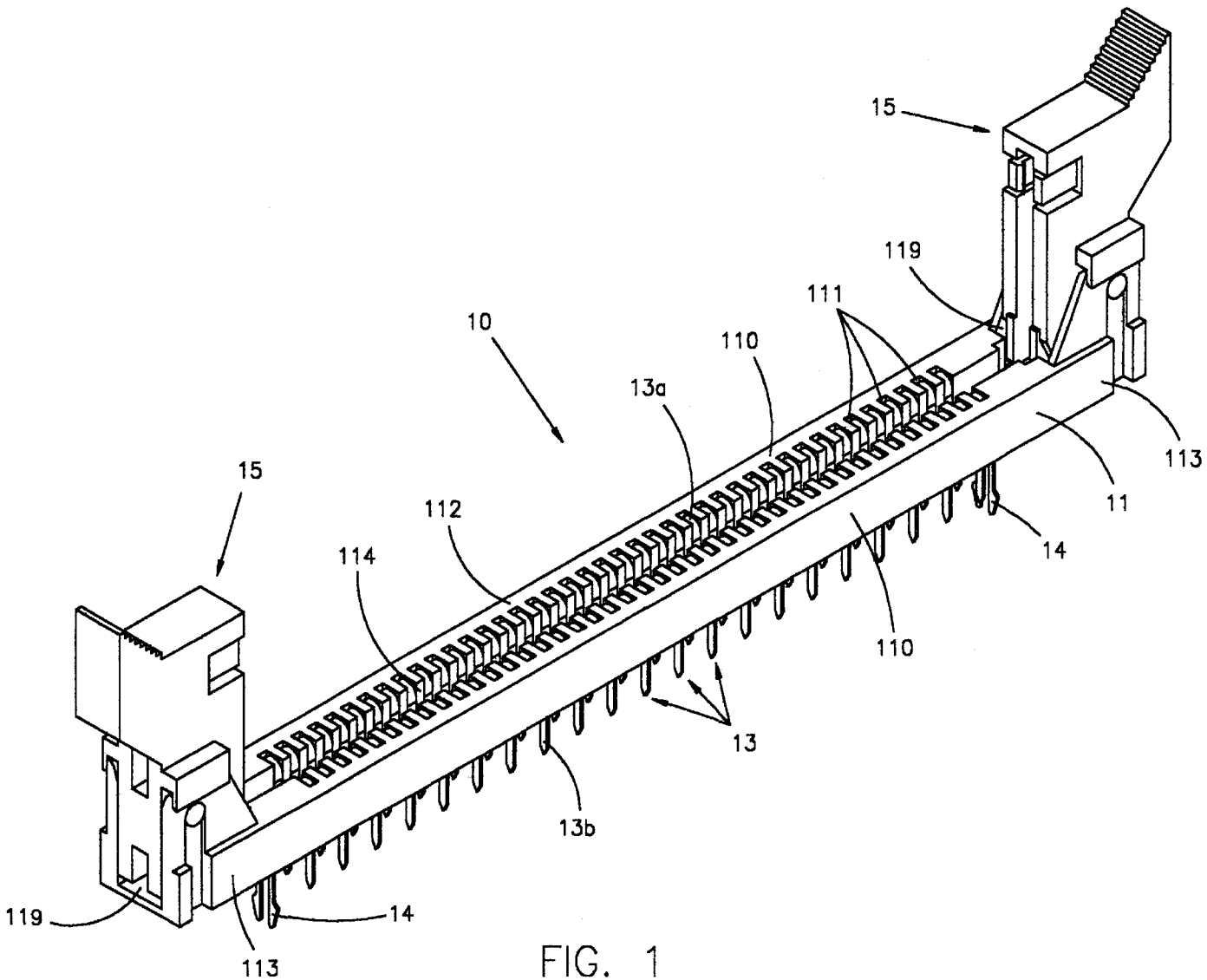
FIG. 1 is a perspective view of an edge card connector according to the present invention.

FIG. 1 shows the edge card connector 10 of the present invention. The connector 10 includes an insulative housing 11 comprising a first wall 110 and second wall 110 extending from a first end 113 to a second end 113. The walls 110 define a top face 112 and provide a slot 114 between the walls 110. Terminal cavities 111 are disposed in the first wall and the second wall adjacent to the slot 114. Terminals 13 are disposed in each of the terminal cavities 111. Each terminal has a contact portion 13*a* extending into the slot for contacting conductive pads on a first circuit board or daughter circuit board 12 (FIG. 5) inserted into the slot. Moreover, a tail portion 13*b* extending out of the housing 11 contacts conductors on a second circuit board or mother circuit board (not shown). At least one board lock 14 or other fastening device may be used to secure the connector 10 to the mother circuit board. First and second recesses 119 are disposed in the first and second ends 113 of the housing 11, respectively. First and second levers 15 are disposed in first and second recesses, respectively, at both ends 113 of the housing 11.

Figure 2:
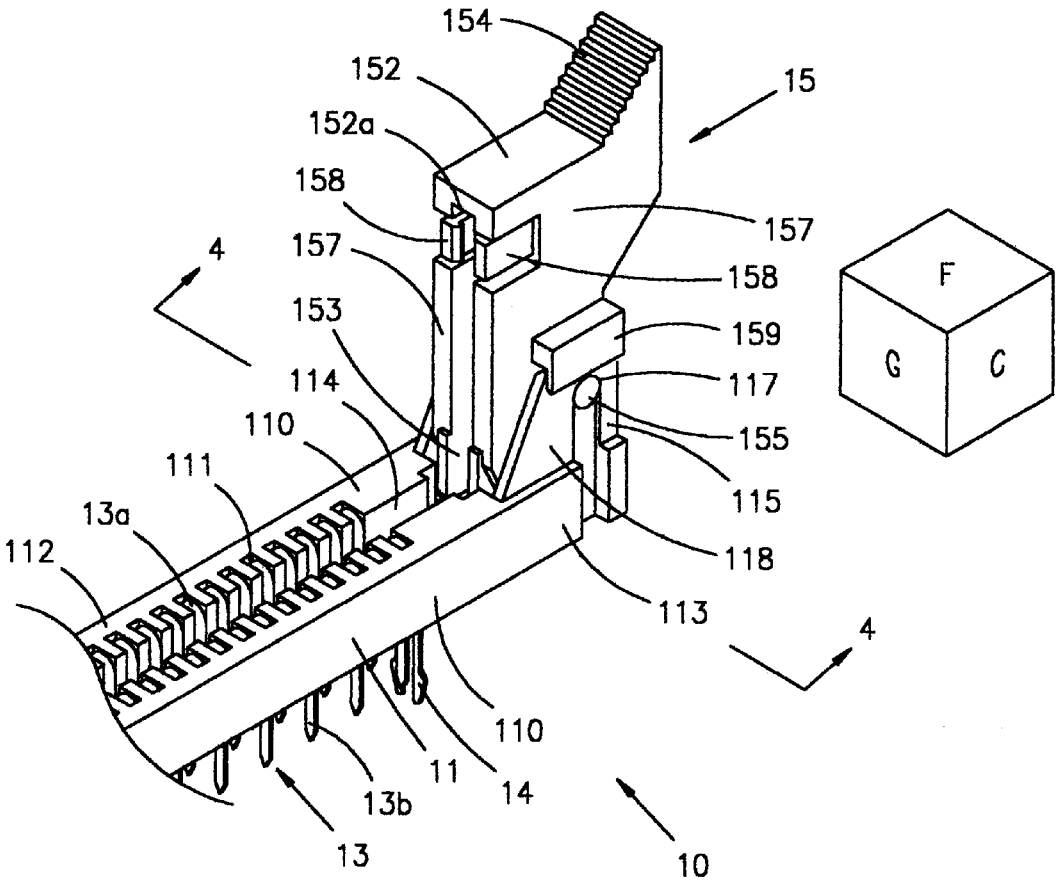
FIG. 2 is a perspective detailed view of a portion of the connector in FIG. 1.
Figure 3:
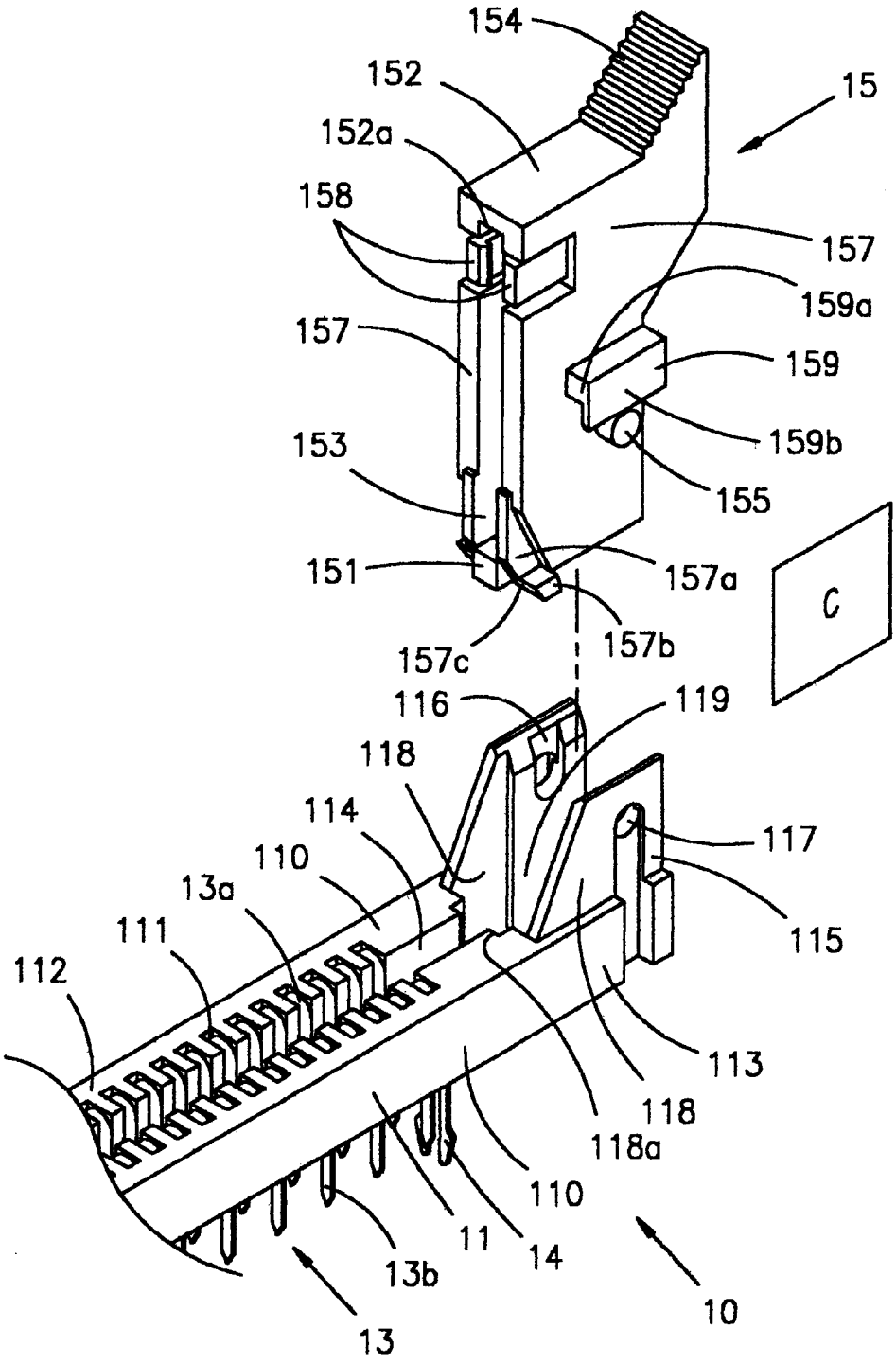
FIG. 3 is an exploded view of FIG. 2.
Figure 4:
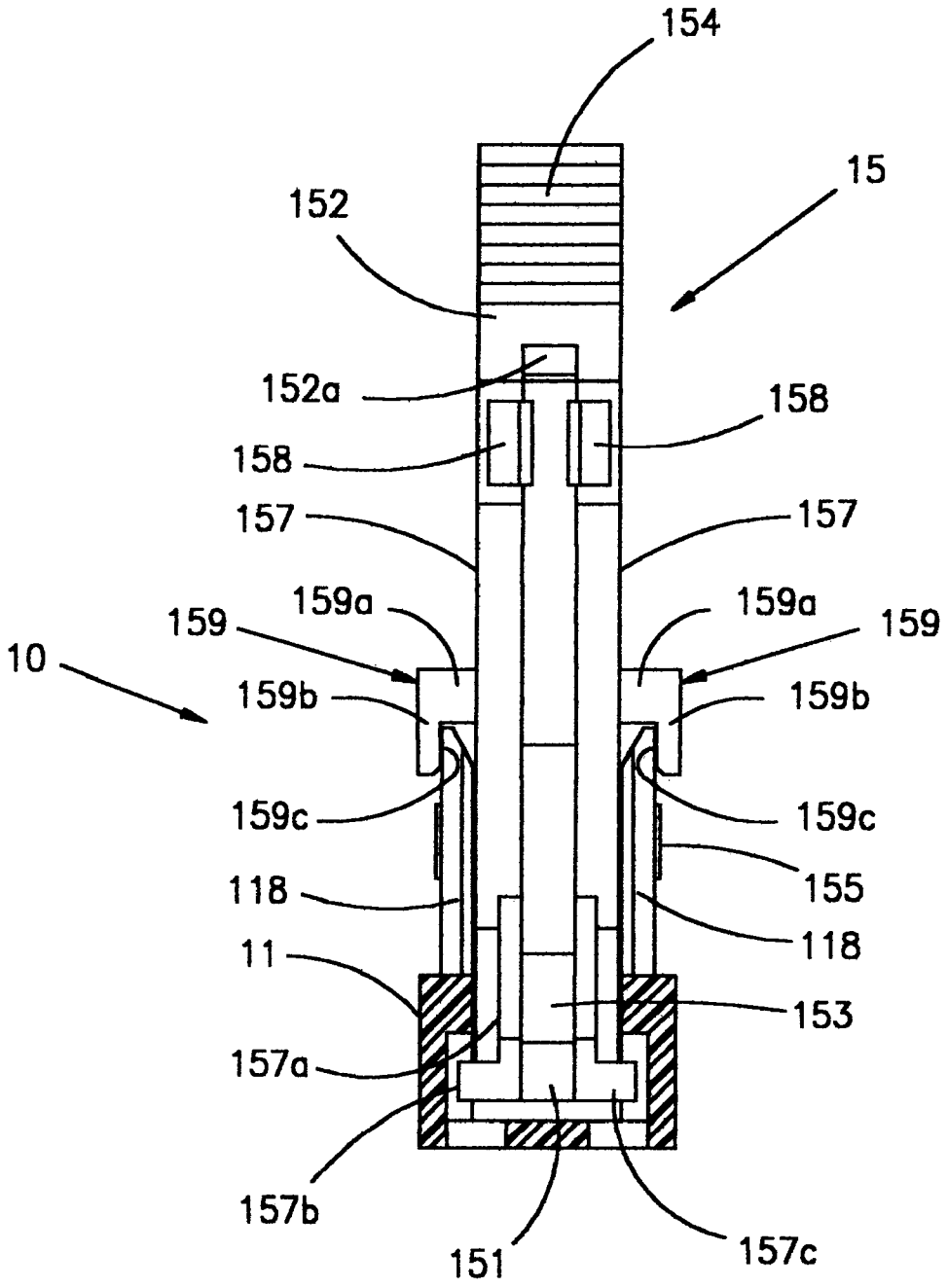
FIG. 4 is a cross sectional view taken along segment 4—4 of FIG. 2.

FIGS. 2–4 show one end 113 and the associated lever 15 of the connector 10 of the present invention in greater detail. In FIG. 3, the lever 15 is removed from the housing for illustrative purposes. Each of the recesses 119 include first and second recess walls 118 having notches 116 therein each descending downwardly and terminating in a circular aperture 117. First and second walls 118 of each recess preferably extend upwardly from the top face 112 of the housing 11.

The lever 15 is molded from an insulative material and includes a bottom wall 151 and a top wall 152. A gripping section 154 extends upwardly from the top wall 152 of the connector to facilitate manually rotating the lever. Opposed first and second walls 157 of the lever define a central slit 153. Shafts 155 extend outwardly from each of the first and second sidewalls 157 of the lever. The shafts are inserted through the notches 116 of walls 118 of the recess 119 in the housing and seat in the apertures 117 at the bottom of the notch 116 to rotatably mount the lever 15 in the recess 119 of the housing 11. Other means of rotatably mounting the lever 15, such as by fashioning apertures in the lever for receiving shafts projecting from the walls 118 of the recess 119, although not shown, are also contemplated as part of the invention. The lever 15 also includes resilient fingers 158 which are free to flex inwardly and outwardly to grip a portion of the first circuit board that is received in the slit 153. A mid-portion of the front surface of the top wall 152 of lever 15 includes an arcuate recess 152*a* to facilitate reception of the portion of the first circuit board.

An inventive aspect of the lever 15 of the connector 10 is the formation of support arms 159 on one or both sides of the lever 15. The support arms 159 preferably comprise a first horizontal segment 159*a* extending outwardly from a respective sidewall 157 of the lever 15 and a vertical segment 159*b* descending downwardly from the horizontal segment 159*a*. The vertical segment 159*b* defines an interior vertical surface 159*c* as best seen in FIG. 4. Preferably, the lower end of the vertical surface 159*c* has a chamfered edge to facilitate insertion of the lever 15 into the recess 119 during assembly. Additionally, top edges of the recess walls 118 may be chamfered to also facilitate insertion of the lever 15 into the recess 119 during assembly. The lower end of side walls of the lever 15 include formations 157*a* including a stop block 157*b* with an inner angular surface 157*c* for engaging a front surface 118*a* of recess 119 in the housing to limit inward rotation of the bottom wall 151 of the lever 15.

Figure 5:
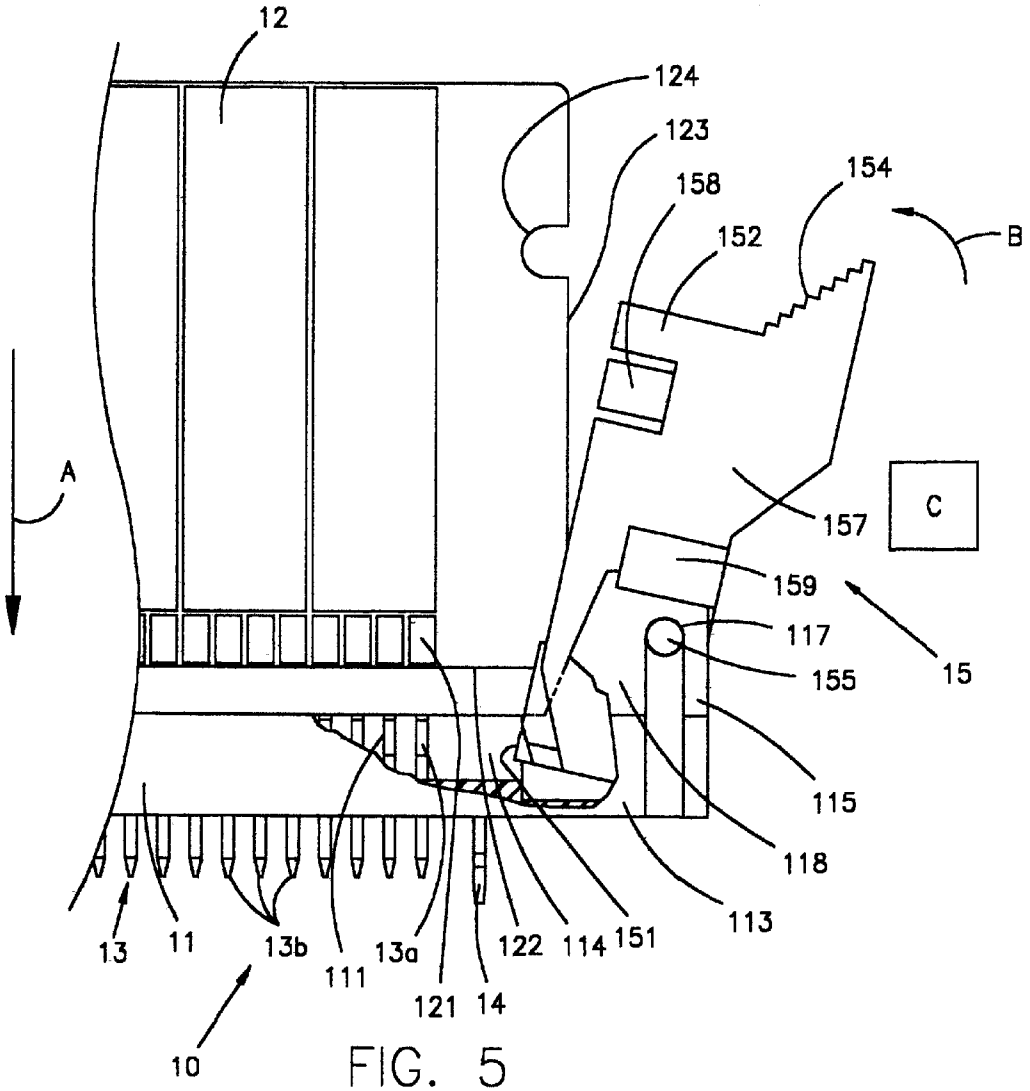
FIG. 5 is a broken away schematic drawing of the connector of FIG. 1 with a lever turned outwardly to receive a daughter circuit board.
Figure 6:
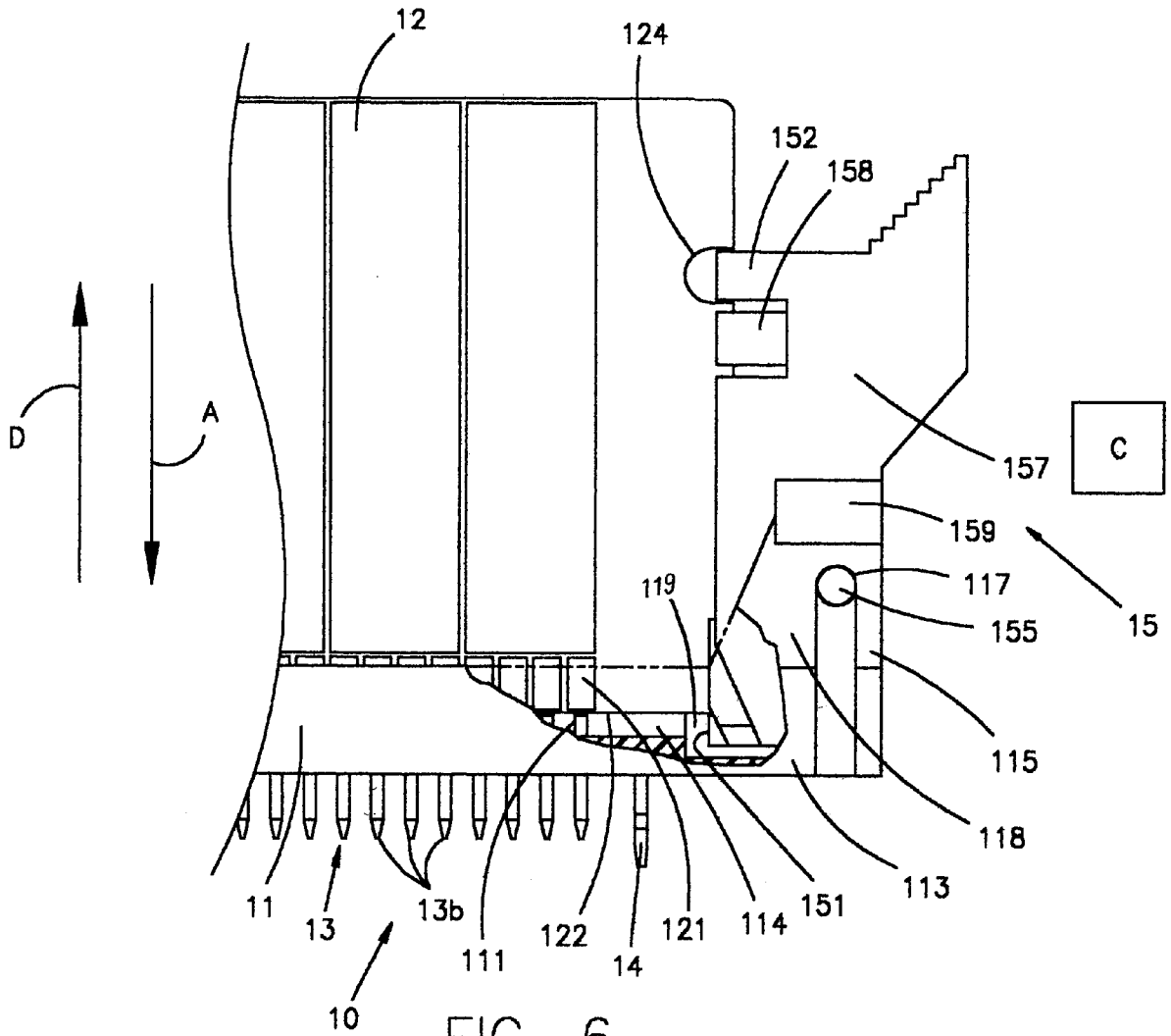
FIG. 6 is a broken away schematic drawing of the connector of FIG. 1 with the daughter circuit board inserted into the connector and the lever turned inwardly and engaged with the circuit board.
Figure 7:
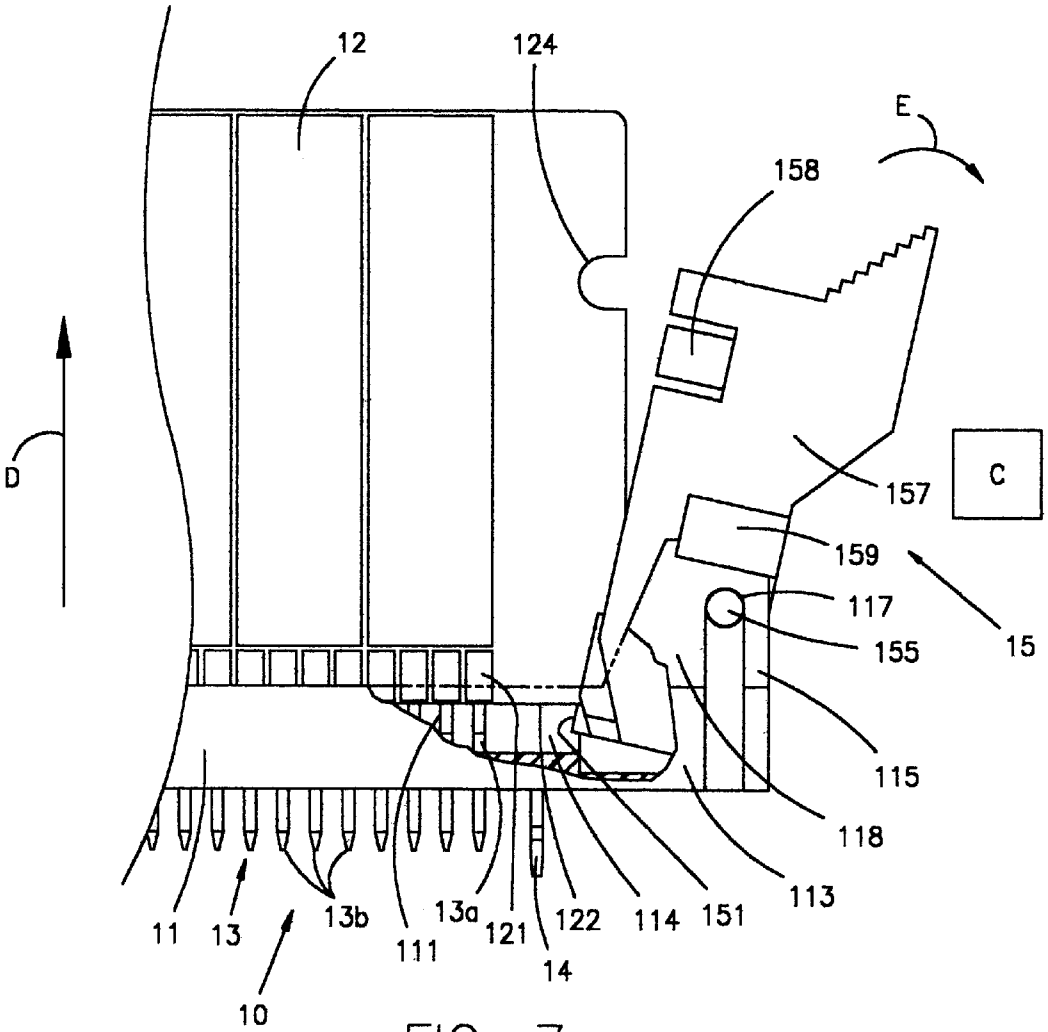
FIG. 7 is a broken away schematic drawing of the connector of FIG. 1 with the lever turned outwardly and pushing the daughter circuit board out of the connector.
Figure 8:
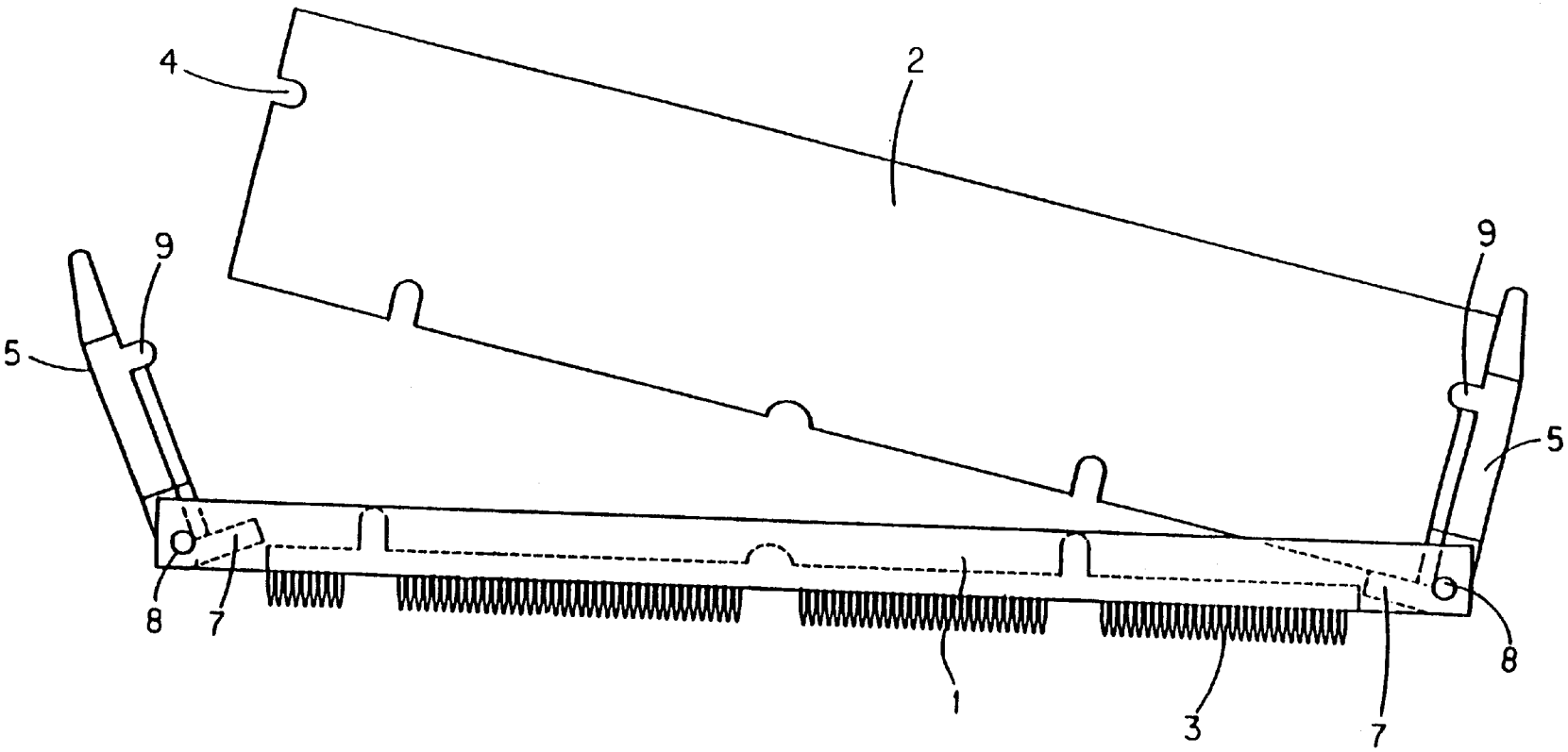
FIG. 8 (PRIOR ART)
FIG. 8 illustrates a connector for a daughter circuit board according to the prior art.
Figure 9:
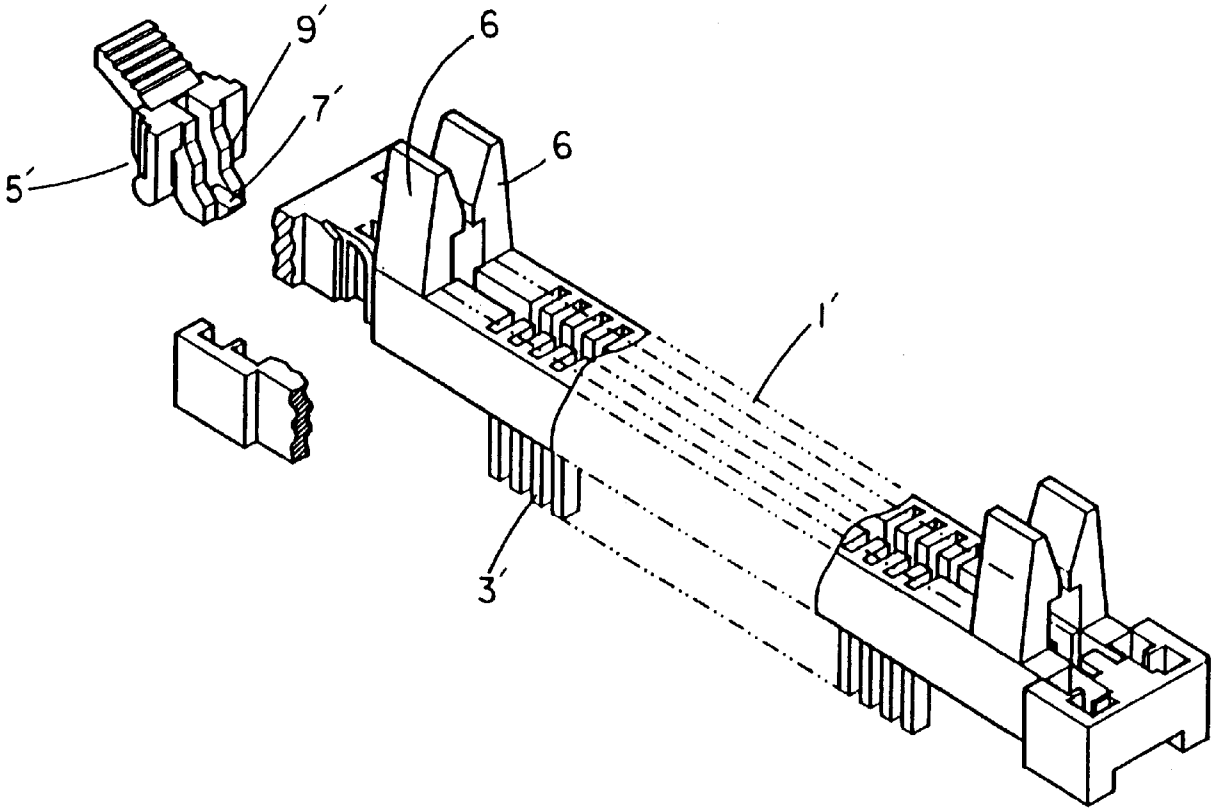
FIG. 9 (PRIOR ART)
FIG. 9 illustrates an alternative connector for a daughter circuit board according to the prior art.

FIGS. 5–7 show operation of the lever 15 with respect to insertion and ejection of the first circuit board or daughter circuit board 12 in and from the connector 10, respectively. A portion of one of the walls 110 is removed in FIGS. 5–7 to illustrate the interaction between the lever 15 and the daughter circuit board 12. The daughter board 12 includes contact pads 121 arranged along a lower edge 122. An outer edge 123 of the daughter board includes a side notch 124 for latching purposes. Respective ones of the contact pads 121 will be engaged with contact portions 13*a* of the terminals 13 to effectuate electrical connection between the contact pad 121 and an appropriate conductor on the mother board (not shown).

FIG. 5 shows the connector 10 with the lever 15 in an open position poised to receive the first circuit board 12 within slot 114. The daughter circuit board 12 is inserted into the slot 114 in the housing 11 in the direction of arrow A during which a portion of the outer edge 123 enters into the slit 153 in lever 15 (FIG. 2). The slit 153 is aligned with the slot 114 to facilitate entry of the portion of the outer edge 123 of the daughter circuit board 12 into the slit 153. As the daughter circuit board 12 is inserted into the slot 114, the lower edge 122 of the circuit board 12 engages a top surface of the bottom wall 151 of the lever 15, thereby urging the bottom wall 151 downwardly and rotating the lever 15 counterclockwise in the direction of arcuate arrow B in a plane C about shafts 155 seated in apertures 117. The arcuate recess 152*a* (FIGS. 2–4) facilitates entry of the top wall 152 into the side notch 124 and reception of the portion of the outer edge 123 into the slit 153 of lever 15.

FIG. 6 shows the daughter circuit board 12 completely inserted into the slot 114 of the housing 11. The bottom surface of the bottom wall 151 is in engagement with the bottom of the recess 119 of the housing 11 and is thereby at the limit of the inward rotation of the lever 15. Additionally, the top wall 152 is engaged with the side notch 124 in daughter circuit board 12 and resilient fingers 158 are gripping opposing sides of the daughter circuit board 12. The top wall 152 engages the side notch 124 to latch the daughter circuit board 12 within slot 114 of the housing 11. Furthermore, the portion of the outer edge 123 below the side notch 124 is nested within the slit 153 of the lever 15. Accordingly, although not visible from the view in FIG. 6, contact portions 13*a* of terminals 13 are in engagement with contact pads 121 on the daughter circuit board 12.

To eject the daughter circuit board 12 from the connector 10 in a direction of arrow D, the lever 15 is rotated in the direction of arcuate arrow E in the plane C as shown in FIG. 7. Upon rotation, the top surface of bottom wall 151 of the lever 15 is rotated upwardly to engage bottom edge 122 of the daughter circuit board 12, thereby urging the daughter circuit board in a direction of arrow D and disengaging contact pads 121 on the daughter board 12 from engagement with contact portions 113*a* of terminals 13 in cavities 111. It can be seen that upon rotation of the lever 15 in the direction or arcuate arrow E, the top wall 152 disengages from the side notch 124 to permit the daughter circuit board 12 to move upwardly in the direction of arrow D. Moreover, resilient fingers 158 disengage from their gripping relationship with the sides of the daughter circuit board 12.

All the while that the lever 15 is rotated in the directions of arcuate arrows B and E, the inner vertical surface of the vertical segment 159*b* remains in engagement or juxtaposition with a portion of outer surface of the upstanding recess walls 118. Consequently, the lever 15 is limited from swivelling or rotating in a plane, such as planes G or F as shown in FIG. 2, that is angularly related to the plane C of rotation shown in FIGS. 2, 3, 5, 6 and 7. Additionally, the support arm 159 also mitigates vibration of the lever 115.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for connecting a first circuit board to a second circuit board, said electrical connector comprising:

an insulative housing having a first wall and a second wall extending from a first end to a second end and defining a top face, a slot in said top face extending from said first end to said second end between said first and second walls for receiving said first circuit board therein, terminal cavities disposed in at least one of said first wall and said second wall adjacent to said slot, and a recess in at least one of said first end and said second end, said recess being defined at least in part by a pair of spaced apart recess walls;

a plurality of terminals disposed in said terminal cavities, each of said terminals having a contact portion extending into said slot for contacting conductive pads on said first circuit board when received in said slot and a tail portion extending out of said insulative housing to contact conductors of said second circuit board;

a lever rotatably mounted in said recess at said at least one of said first end and said second end of said insulative housing, said lever being configured for rotational movement in a first plane to affect a position of the first circuit board in said slot, said lever including first and second oppositely facing sidewalls and a support arm projecting from each of said first and second sidewalls, each support arm having a vertical surface spaced from the sidewalls and configured such that each recess wall of said housing is interposed between one of the lever sidewalls and a respective one of said vertical surfaces for limiting movement of said lever outside of said first plane.

2. The connector of claim 1 wherein said lever has two sides and said support arm extends from each side.

3. The connector of claim 1 wherein said recess in said insulative housing includes a first wall and a second wall.

4. The connector of claim 3 wherein said first wall and said second wall of said recess extend upwardly from said top face, and said support arm is adjacent to said first wall.

5. The connector of claim 3 wherein said housing includes a first aperture in a first side of said recess in registry with a second aperture in said second side of said recess, and said lever includes a first shaft and a second shaft for reception in respective ones of said first aperture and said second aperture to rotatably mount said lever in said recess.

6. The connector of claim 1 wherein said vertical surface has a lower end and said lower end of said vertical surface is chamfered.

7. The connector of claim 1 wherein said lever has an ejecting surface for engaging a portion of said first circuit board and lifting said first circuit board up in said slot upon rotation of said lever.

8. The connector of claim 1 wherein said lever has a latching surface for engaging a portion of said first circuit board and holding said first circuit board down in said slot.

9. An electrical connector for connecting a first circuit board to a second circuit board, said electrical connector comprising:

an insulative housing having a first wall and a second wall extending from a first end to a second end and providing a top face, a slot in said top face extending from said first end to said second end between said first and second walls for receiving said first circuit board therein, terminal cavities disposed in said first wall and said second wall adjacent to said slot, and a first recess in said first end and a second recess in said second end, said first and second recesses each including a first wall opposed to a second wall with a first aperture in said first wall in registry with a second aperture in said second wall;

a plurality of terminals disposed in said terminal cavities, each of said terminals having a contact portion extending into said slot for contacting conductive pads on said first circuit board when received in said slot and a tail portion extending out of said insulative housing to contact conductors on said second circuit board;

a lever mounted in each of said recesses at said first end and said second end of said insulative housing, said levers for rotational movement in a first plane to affect a position of the first circuit board in said slot, said lever including an extended gripping section for rotating said lever and a first shaft and a second shaft for reception into respective ones of said first aperture and said second aperture to rotatably mount said lever in said recess, said lever having a first side and a second side and a support arm projecting from each of said first and second sides, each support arm including a horizontal segment extending outwardly from a respective one of said first side and said second side of said lever, each support arm further including a vertical segment extending downwardly from said horizontal segment such that one of said recess walls of said housing is interposed between said respective one of said first side and said second side of said lever and said vertical segment for limiting said lever from rotating outside of the first plane.

10. The connector of claim 9 wherein said first wall and said second wall of said recess extend upwardly from said top face and said support arm is adjacent to said first wall.

11. The connector of claim 9 wherein said vertical segment has an inner surface and a lower end of the inner surface is chamfered.

12. The connector of claim 9 wherein said lever has an ejecting surface for engaging a portion of said first circuit board and lifting said first circuit board up in said slot upon rotation of said lever.

13. The connector of claim 9 wherein said lever has a latching surface for engaging a portion of said first circuit board and holding said first circuit board down in said slot.

14. A lever for being rotatably mounted in an electrical connector, said lever comprising a first side and a second side; one of a first shaft and a first aperture on said first side and one of a second shaft and a second aperture on said second side for rotatably mounting said lever on the electrical connector; an extended gripping section for manually engaging said lever to cause rotation of said lever when mounted; an upwardly facing surface on said lever for engaging a lower edge of a board; and a support arm including a horizontal segment extending outwardly from each of said first side and said second side of said lever, each support arm further including a vertical segment extending downwardly from said horizontal segment and being spaced from its respective side.

15. An electrical connector for connecting a first circuit board to a second circuit board, said electrical connector comprising:

an insulative housing having a first wall and a second wall extending from a first end to a second end and defining a top face, a slot in said top face extending from said first end to said second end between said first and second walls for receiving said first circuit board therein, terminal cavities disposed in at least one of said first wall and said second wall adjacent to said slot, and a recess in at least one of said first end and said second end, said recess including a first wall spaced from a second wall;

a plurality of terminals disposed in said terminal cavities, each of said terminals having a contact portion extending into said slot for contacting conductive pads on said first circuit board when received in said slot and a tail portion extending out of said insulative housing to contact conductors on said second circuit board;

a lever mounted in said recess at said at least one of said first end and said second end of said insulative housing, said lever being configured for rotational movement in a first plane to affect a position of the first circuit board in said slot, said lever having a first side and a second side, said lever including an extended gripping section for rotating said lever, said lever including a support arm with a horizontal segment extending outwardly from each of said first and second sides of said lever and a vertical segment extending downwardly from each of said horizontal segments adjacent to a portion of said housing to limit said lever from rotating in a plane outside of said first plane.

16. The connector of claim 15 wherein said lever has two sides and said arm extends from each side.

17. The connector of claim 15 wherein said first wall and said second wall of said recess extend upwardly from said top face and said support arm is adjacent to said first wall.

18. The connector of claim 15 wherein said vertical segment has an inner surface and a lower end of the inner surface is chamfered.

19. The connector of claim 15 wherein said lever has an ejecting surface for engaging a portion of said first circuit board and lifting said first circuit board up in said slot upon rotation of said lever.

20. The connector of claim 15 wherein said lever has a latching surface for engaging a portion of said first circuit board and holding said first circuit board down in said slot.

* * * * *